US008862019B2

(12) United States Patent
Komiyama et al.

(10) Patent No.: US 8,862,019 B2
(45) Date of Patent: Oct. 14, 2014

(54) CLEANING DEVICE AND IMAGE FORMING APPARATUS INCLUDING THE SAME

(75) Inventors: Tsutomu Komiyama, Kanagawa (JP); Masaaki Tokunaga, Kanagawa (JP); Masakazu Shirai, Kanagawa (JP); Kazuyoshi Hagiwara, Kanagawa (JP); Kazutoshi Sugitani, Kanagawa (JP); Koichi Sato, Kanagawa (JP); Masaaki Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 201 days.

(21) Appl. No.: 13/481,131

(22) Filed: May 25, 2012

(65) Prior Publication Data

US 2013/0142539 A1 Jun. 6, 2013

(30) Foreign Application Priority Data

Dec. 6, 2011 (JP) ..... 2011-266767

(51) Int. Cl.
*G03G 15/16* (2006.01)

(52) U.S. Cl.
CPC ..... *G03G 15/161* (2013.01)
USPC ..... 399/101

(58) Field of Classification Search
CPC ..... G03G 15/161; G03G 15/168; G03G 2215/1661
USPC ..... 399/101, 345
See application file for complete search history.

(56) References Cited

U.S. PATENT DOCUMENTS 4,640,608 A * 2/1987 Higaya et al. ..... 399/102
6,925,282 B2 * 8/2005 Drawe et al. ..... 399/349
7,251,448 B2 * 7/2007 Pozniakas et al. ..... 399/350

FOREIGN PATENT DOCUMENTS

JP 3940158 B2 7/2007
JP 2011-022582 A 2/2011

* cited by examiner

*Primary Examiner* — David Gray
(74) *Attorney, Agent, or Firm* — Sughrue Mion, PLLC

(57) ABSTRACT

A cleaning device includes at least one first cleaning member that removes residual substances that remain on a surface of an endless belt by being in contact with the surface of the endless belt while rotating in a direction that is opposite to a movement direction in which the endless belt moves; a second cleaning member that is brought into contact with and separated from the surface of the endless belt at a predetermined timing and removes the residual substances that remain on the surface of the endless belt; and a switching unit that switches a rotation direction of the first cleaning member to a direction the same as the movement direction of the endless belt when the second cleaning member is brought into contact with the surface of the endless belt and cleans the surface.

7 Claims, 7 Drawing Sheets

FIG. 7

| BLADE IN CONTACT/ SEPARATED FROM | BRUSH SCRAPING DEPTH [mm] | NUMBER OF REVOLUTIONS [rpm] (ASSIST DIRECTION) | BIAS VOLTAGE | STARTING TORQUE [N·cm] | STEADY STATE TORQUE [N·cm] | ASSIST FORCE [N] |
|---|---|---|---|---|---|---|
| SEPARATED FROM | 1.4 | 0 | 0 | 4.5 | 4.1 | - |
| IN CONTACT | 1.4 | 0 | 0 | 10.4 | 9.7 | - |
| IN CONTACT | 1.4 | 87.2 | 0 | 5.5 | 4.8 | 1.8 |
| IN CONTACT | 1.4 | 87.2 | 200 | 5.7 | 4.7 | 1.9 |
| SEPARATED FROM | 0.75 | 0 | 0 | 3.5 | 3.1 | - |
| IN CONTACT | 0.75 | 0 | 0 | 9.3 | 8.6 | - |
| IN CONTACT | 0.75 | 87.2 | 0 | 7.7 | 7.0 | 0.3 |
| IN CONTACT | 0.75 | 87.2 | 200 | 7.1 | 6.5 | 0.6 |

CLEANING DEVICE AND IMAGE FORMING APPARATUS INCLUDING THE SAME

CROSS-REFERENCE TO RELATED APPLICATIONS

This application is based on and claims priority under 35 USC 119 from Japanese Patent Application No. 2011-266767 filed Dec. 6, 2011.

BACKGROUND

1. Technical Field

The present invention relates to a cleaning device and an image forming apparatus including the cleaning device.

2. Summary

According to an aspect of the invention, a cleaning device includes at least one first cleaning member that removes residual substances that remain on a surface of an endless belt by being in contact with the surface of the endless belt while rotating in a direction that is opposite to a movement direction in which the endless belt moves; a second cleaning member that is brought into contact with and separated from the surface of the endless belt at a predetermined timing and removes the residual substances that remain on the surface of the endless belt; and a switching unit that switches a rotation direction of the first cleaning member to a direction the same as the movement direction of the endless belt when the second cleaning member is brought into contact with the surface of the endless belt and cleans the surface.

BRIEF DESCRIPTION OF THE DRAWINGS

Exemplary embodiments of the present invention will be described in detail based on the following figures, wherein:

FIG. 7 is a table illustrating the result of the experiment; and

DETAILED DESCRIPTION

Hereinafter, exemplary embodiments of the present invention will be described with reference to the drawings.

First Embodiment

Figure 2:
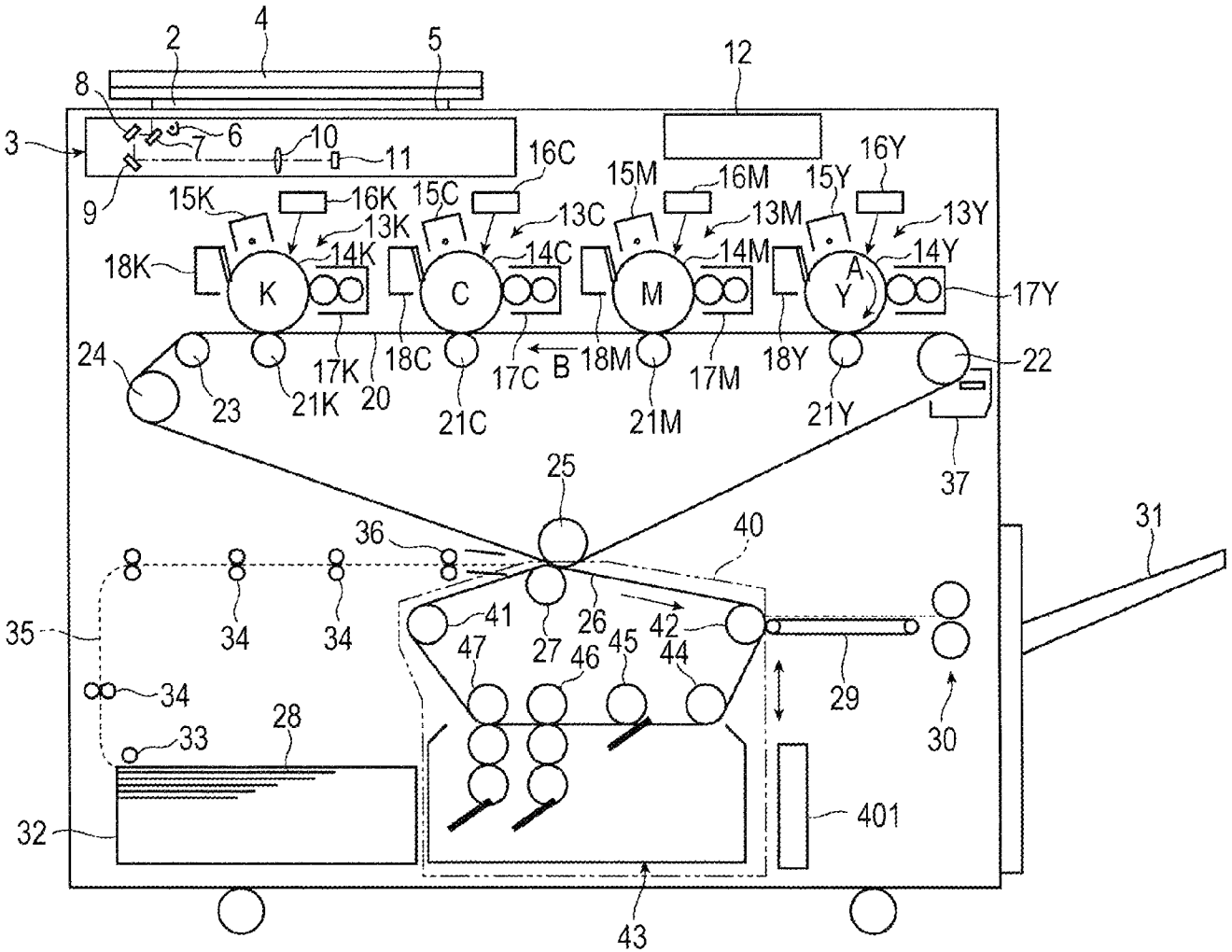
FIG. 2 is a schematic view of the image forming apparatus including the cleaning device according to the first exemplary embodiment of the present invention.

FIG. 2 illustrates a tandem full-color image forming apparatus including a cleaning device according to a first exemplary embodiment of the present invention. The tandem full-color image forming apparatus includes an image reader, so that the apparatus also functions as a full-color copier. However, the image reader may be omitted.

In FIG. 2, an image reader 3, which reads an image of a document 2, is disposed in an upper end portion (upper left end portion in this example) of an image forming apparatus body 1. In the image reader 3, the document 2 is irradiated with light emitted by a light source 6 while the document 2 is placed on a platen glass 5 and is pressed by a document pressing member 4. Light reflected from the document 2 passes through a reduction optical system, which includes a full-rate mirror 7, half-rate mirrors 8 and 9, and an imaging lens 10; and the light is scanned over an image reading element 11 such as a CCD. Thus, the image reading element 11 reads an image of the document 2 with a predetermined dot pitch.

The image of the document 2, which has been read by the image reader 3, is sent to an image processor 12 as, for example, image data of three colors that are red (R), green (G), and blue (B). The image processor 12 performs, on the image data of the document 2, predetermined image processing operations such as shading correction, displacement correction, brightness/color conversion, gamma correction, frame erasing, and color/movement edition. The image data, which has been subjected to the predetermined image processing as described above by the image processor 12, is converted to image data of four colors that are cyan (C), magenta (M), yellow (Y), and black (K) by the image processor 12. The colors of image data converted by the image processor 12 are not limited to these four colors, which are cyan (C), magenta (M), yellow (Y), and black (K). Alternatively, the colors may be six colors including high-chroma cyan (HC) and high-chroma magenta (HM). Further alternatively, the number of colors may be any appropriate number. Image data may be input to the image processor 12 from a personal computer or the like through a communication line (not shown).

The present exemplary embodiment includes plural image forming units that form images by using toners of different colors.

That is, as illustrated in FIG. 2, in the image forming apparatus body 1 according to the present exemplary embodiment, image forming units 13Y, 13M, 13C, and 13K, which respectively correspond to yellow (Y), magenta (M), cyan (C), and black (K) are parallelly arranged along a horizontal direction at a regular pitch. The image forming units 13Y, 13M, 13C, and 13K for yellow (Y), magenta (M), cyan (C), and black (K) may be arranged in an order different from that of FIG. 2.

Each of the image forming units 13Y, 13M, 13C, and 13K for yellow (Y), magenta (M), cyan (C), and black (K) is an integrated unit. The image forming units 13Y, 13M, 13C, and 13K, excluding image exposure devices 16Y, 16M, 16C, and 16K described below, are independently removable from the image forming apparatus body 1.

As illustrated in FIG. 2, the four image forming units 13Y, 13M, 13C, and 13K have the same structure except for the type of toner used. Each of the image forming units includes a photoconductor drum 14, a scorotron 15, an image exposure device 16, a developing device 17, and a cleaning device 18. The photoconductor drum 14, which is an example of an image carrier, is driven at a predetermined rotation speed in the direction of arrow A. The scorotron 15, which is an example of a first charger, uniformly charges a surface of the photoconductor drum 14. The image exposure device 16, which is an example of a latent image forming unit, exposes the surface of the photoconductor drum 14 so as to form an electrostatic latent image of a corresponding color. The developing device 17 develops the electrostatic latent image formed on the photoconductor drum 14 by using toner of the corresponding color. The cleaning device 18 removes residual toner and the like remaining on the photoconductor drum 14.

The photoconductor drums 14Y, 14M, 14C, and 14K of the image forming units 13Y, 13M, 13C, and 13K for yellow (Y), magenta (M), cyan (C), and black (K) are charged to a predetermined negative potential by scorotrons 15Y, 15M, 15C, and 15K. Subsequently, the image processor 12 successively outputs image data of corresponding colors to the image exposure devices 16Y, 16M, 16C, and 16K of the image forming units 13Y, 13M, 13C, and 13K for yellow (Y), magenta (M), cyan (C), and black (K). The image exposure devices 16Y, 16M, 16C, and 16K emit laser beams LB in accordance with the image data; the surfaces of the corresponding photoconductor drums 14Y, 14M, 14C, and 14K are scanned by the laser beams in the main scanning direction (the axial direction of the photoconductor drum); and thereby electrostatic latent images are formed on the surfaces of the photoconductor drums 14Y, 14M, 14C, and 14K. The developing devices 17Y, 17M, 17C, and 17K reversely develop the electrostatic latent images, which have been formed on the photoconductor drums 14Y, 14M, 14C, and 14K, to form toner images composed of negatively charged toners of yellow (Y), magenta (M), cyan (C), and black (K).

As illustrated in FIG. 2, an intermediate transfer belt 20, which is an example of an intermediate transfer member, is disposed below the image forming units 13Y, 13M, 13C, and 13K. The toner images of yellow (Y), magenta (M), cyan (C), and black (K), which have been successively formed on the photoconductor drums 14Y, 14M, 14C, and 14K of the image forming units 13Y, 13M, 13C, and 13K, are overlappingly first-transferred to the intermediate transfer belt 20 in first-transfer regions by first transfer rollers 21Y, 21M, 21C, and 21K.

The intermediate transfer belt 20 is looped over plural rollers including a driving roller 22, a driven roller 23, a tension roller 24, and a back-support roller 25 with a predetermined tension. The back-support roller is disposed in a second transfer region. The driving roller 22 is rotated by a dedicated driving motor (not shown) that is capable of rotating at a highly constant speed. The intermediate transfer belt 20 is driven by the driving roller 22 in the direction of arrow B at a predetermined speed that is substantially the same as the rotation speed (circumferential speed) of the photoconductor drums 14Y, 14M, 14C, and 14K. The intermediate transfer belt 20 is, for example, an endless-belt-shaped synthetic resin film that is made from a plastic resin such as a polyimide resin or a polyamide-imide resin.

A second transfer roller 27 is pressed against the back-support roller 25 with the intermediate transfer belt 20 and a second transfer belt 26 therebetween, and a second transfer bias voltage is applied to the second transfer roller 27. The toner images of yellow (Y), magenta (M), cyan (C), and black (K), which have been overlappingly transferred to the intermediate transfer belt 20, are simultaneously second-transferred to a recording sheet 28, which is an example of a recording medium, due to the second transfer voltage. After the toner images of the four colors have been transferred, the recording sheet 28 is peeled off the second transfer belt 26 and transported by a transport belt 29 to a fixing device 30, which is an example of a fixing unit. The fixing device 30 fixes the toner images, which have been transferred to the recording sheet 28, onto the recording sheet 28 by using heat and pressure. Then, the recording sheet 28 is output to an output tray 31 that is disposed outside of the image forming apparatus body 1.

As illustrated in FIG. 2, the recording sheet 28, which has a predetermined size and quality, is picked up from a feed tray 32 and separated from other sheets by a feed roller 33 and a pair of sheet separation rollers (not shown), and the recording sheet 28 is transported to a registration roller 36 along a sheet transport path 35, along which plural transport rollers 34 are arranged. The recording sheet 28, which has been supplied from the feed tray 32, is transported to a second transfer position by the registration roller 36, which is rotated at a predetermined timing, in synchronism with the toner images on the intermediate transfer belt 20.

The cleaning devices 18Y, 18M, 18C, and 18K cleans the surfaces of the photoconductor drums 14Y, 14M, 14C, and 14K from which the toner image have been first-transferred. A belt cleaning device 37, which is disposed adjacent to the driving roller 22, cleans the surface of the intermediate transfer belt 20 from which the toner images have been second-transferred.

As illustrated in FIG. 2, the present exemplary embodiment includes a second transfer unit 40 that includes the second transfer belt 26. The second transfer belt 26 is an endless belt looped over plural rollers including the second transfer roller 27. The second transfer unit 40 simultaneously second-transfers the toner images from the intermediate transfer belt 20 to the recording sheet 28.

The second transfer unit 40 is an integrated unit. The second transfer unit 40 is movable by a contact/separation mechanism 401 in directions such that the second transfer belt 26, which is looped over the second transfer roller 27, is brought into contact with and separated from the intermediate transfer belt 20.

Figure 1:
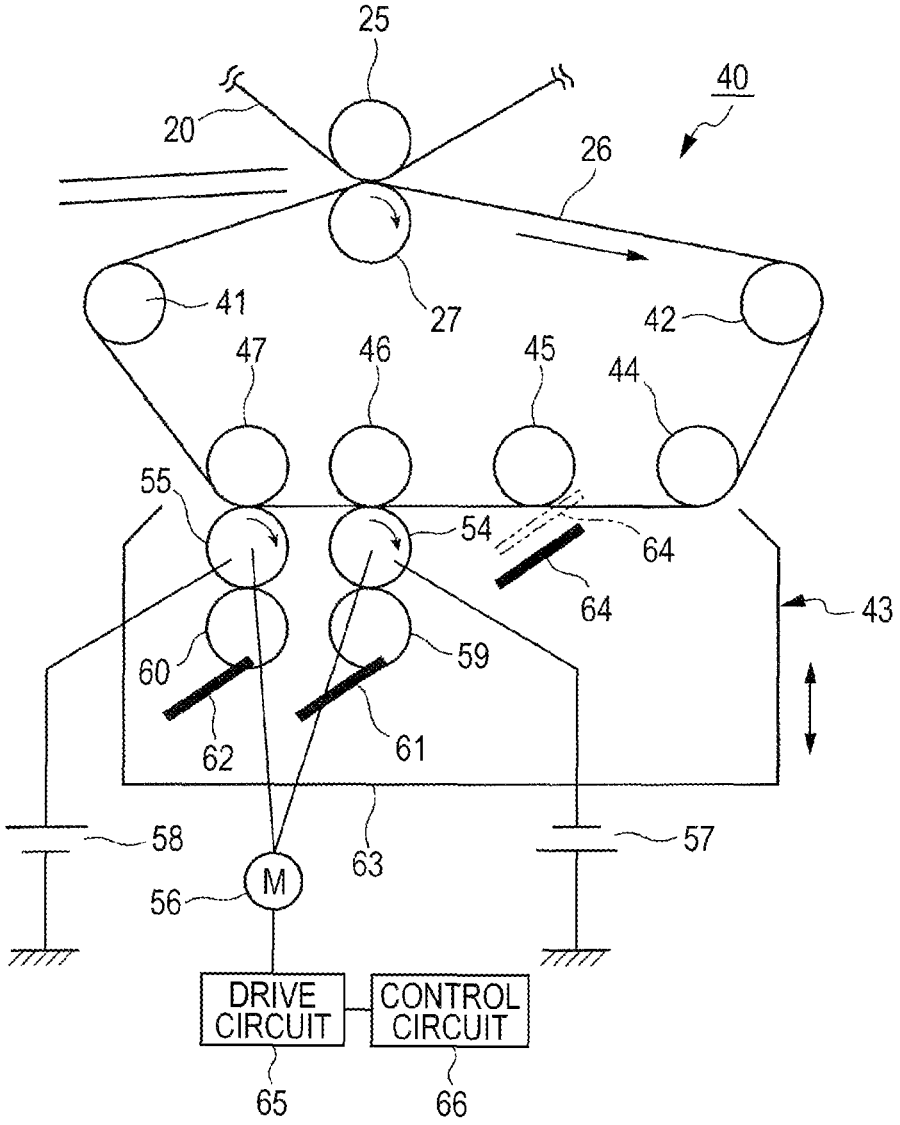
FIG. 1 is a partial schematic view of an image forming apparatus including a cleaning device according to a first exemplary embodiment of the present invention.

As illustrated in FIG. 1, the second transfer unit 40 includes the second transfer belt 26, the second transfer roller 27, a meandering control roller 41, a peel-off roller 42, a cleaning device 43, and plural support rollers. The second transfer belt 26 is an endless belt. The second transfer roller 27 is disposed at the second transfer position, at which the second transfer roller 27 is in contact with the intermediate transfer belt, and drives the second transfer belt. The meandering control roller 41 is disposed upstream of the second transfer roller 27 in the movement direction of the second transfer belt and controls meandering of the second transfer belt. The peel-off roller 42 is disposed downstream of the second transfer roller 27 in the movement direction of the second transfer belt 26, and peels the recording sheet 28 off the second transfer belt 26. The cleaning device 43 removes residual substances remaining on a surface of the second transfer belt 26. The plural support rollers, which are first to fourth support rollers 44 to 47 in the example of FIG. 1, support the second transfer belt 26 so that the second transfer belt 26 faces the cleaning device 43. The meandering control roller 41 controls meandering of the second transfer belt 26 by moving, in a direction that intersects the axial direction, the position of an end thereof in the axial direction on the basis of, for example, an output of an edge sensor (not shown) that detects an edge of the second transfer belt 26.

As with the intermediate transfer belt 20, the second transfer belt 26 is, for example, an endless-belt-shaped synthetic resin film that is made from a plastic resin such as a polyimide resin or a polyamide-imide resin.

Figure 3:
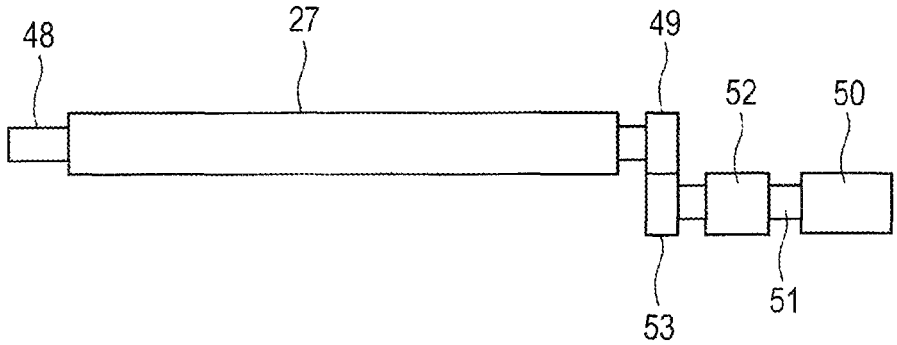
FIG. 3 is a schematic view of a driving system for driving a second transfer roller.

The second transfer roller 27 functions as a driving roller that drives the second transfer belt 26 in the direction of an arrow at a predetermined speed that is slightly higher than that of the intermediate transfer belt 20. As illustrated in FIG. 3, a driven gear 49 is attached to an end of a rotary shaft 48 of the second transfer roller 27. The driven gear 49 meshes with a drive gear 53 that is connected to and driven by a drive shaft 51 of a driving motor 50 via a torque limiter 52. The torque limiter 52, which is an example of a torque limiting unit, transmits only a torque that is equal to or smaller than a set value. The second transfer belt 26 is driven by the second transfer roller 27 at a speed that is slightly (for example, about several percent) higher than that of the intermediate transfer belt 20. This prevents fluctuation in the speeds of the second transfer belt 26 and the intermediate transfer belt 20, which may occur when the leading end of the recording sheet 28 arrives at the second transfer position, at which the second transfer belt 26 and thereby the intermediate transfer belt 20 are in pressed contact with each other, and a load applied to the second transfer belt 26 and the intermediate transfer belt 20 momentarily increases. Thus, occurrence of an image defect (so-called "banding") in a toner image that is transferred from the intermediate transfer belt 20 to the leading end of the recording sheet 28 is prevented.

The torque limiter 52, which is included in the driving system for driving the second transfer roller 27, transmits only a torque that is equal to or smaller than a set value in order to prevent occurrence of an image defect that is so-called banding. However, the set value of the torque limiter 52 should not be too high, because, if the set value of the torque limiter 52 is too high, an image defect (so-called banding) may occur due to a mismatch between the speed of the second transfer belt 26 and the speed of the intermediate transfer belt 20. On the other hand, if the set value of the torque limiter 52 is too low, the effect of preventing occurrence of an image defect (so-called banding) is not sufficiently obtained.

As illustrated in FIG. 1, the cleaning device 43 for cleaning the second transfer belt 26 includes two cleaning brushes 54 and 55, which are examples of a first cleaning member. The cleaning brushes 54 and 55 remove residual substances remaining on the surface of the second transfer belt 26. The cleaning brush 54 is disposed so as be in contact with a part of the surface of the second transfer belt 26 that is supported by the third support roller 46, and the cleaning brush 55 is disposed so as to be in contact with a part of the surface of the second transfer belt 26 that is supported by the fourth support roller 47. Examples of residual substances remaining on the surface of the second transfer belt 26 include toner and toner additives, which have been transferred from the intermediate transfer belt 20, and paper dust of the recording sheet 28. The toner transferred from the intermediate transfer belt 20 includes toner that is charged with the negative polarity, which is a normal charge polarity; and toner that is charged with the positive polarity, which is opposite to the normal charge polarity, due to application of transfer biases at the first transfer position and the second transfer position.

The two cleaning brushes 54 and 55 each include, for example, a core bar and a tape-shaped member. The core bar is made from a metal such as aluminium or a stainless steel. The tape-shaped member includes electroconductive filaments that are affixed thereto with a predetermined density, and the tape-shaped member is wound around the core bar with an electroconductive adhesive therebetween. The two cleaning brushes 54 and 55 are rotated at predetermined speeds by a driving motor 56, which is an example of a driving unit and which is a stepping motor or the like. The rotation direction of the cleaning brushes 54 and 55 is switchable between a direction opposite to the movement direction of the second transfer belt 26 and a direction the same as the movement direction of the second transfer belt 26. Moreover, the rotation speed of the cleaning brushes 54 and 55 is also switchable among plural rotation speeds. The filaments of the two cleaning brushes 54 and 55 may be nonconductive filaments. The number of cleaning brushes is not limited to two, and there may be only one cleaning brush or three or more cleaning brushes as necessary.

The cleaning brush 54, which is disposed on the upstream side in the movement direction of the second transfer belt 26, primarily removes residual toner adhering to the second transfer belt 26 and charged with the positive polarity, which is opposite to the normal charge polarity of toner. For this purpose, a bias voltage having the negative polarity, which is the same as the normal charge polarity, is applied to the cleaning brush 54 by a first bias power supply 57. The cleaning brush 55, which is disposed on the downstream side in the movement direction of the second transfer belt 26, primarily removes residual toner adhering to the second transfer belt 26 and charged with the negative polarity, which is the same as the normal charge polarity. For this purpose, a bias voltage having the positive polarity is applied to the cleaning brush 55 by a second bias power supply 58. Alternatively, a bias voltage having the positive polarity, which is opposite to the normal charge polarity of toner, may be applied to the cleaning brush 54, which is disposed on the upstream side in the movement direction of the second transfer belt 26; and a bias voltage having the negative polarity, which is the same as the normal charge polarity of toner, may be applied to the cleaning brush 55, which is disposed on the downstream side in the movement direction of the second transfer belt 26. However, because toner that adheres to the second transfer belt 26 is more likely to have the opposite polarity due to application the first transfer bias voltage or the second transfer bias voltage, the toner may be first removed by applying a negative bias voltage to the upstream cleaning brush 54.

Recovery rollers 59 and 60 are disposed so as be in contact with the back sides of the two cleaning brushes 54 and 55. The recovery rollers 59 and 60 are metal rollers or the like that are, for example, grounded. The recovery rollers 59 and 60 recover residual substances such as toner, which have been removed by the two cleaning brushes 54 and 55, by electrostatically attracting the residual substances. Then, recovery blades 61 and 62, which are in pressed contact with the surfaces of the recovery rollers 59 and 60, scrape off the residual substances from the recovery rollers 59 and 60, and the residual substances are contained in a housing 63 of the cleaning device 43, which also serves as a recovery container. As necessary, the recovery rollers 59 and 60 are rotated in a direction that is opposite to the rotation direction of the cleaning brushes 54 and 55 by the driving motor 56. Alternatively, toner and the like may be recovered from the two cleaning brushes 54 and 55 not by using the recovery rollers 59 and 60 but by using bar-shaped or plate-shaped flicker members that are disposed so as to be in contact with surfaces of the cleaning brushes 54 and 55.

A cleaning blade 64, which is an example of a second cleaning member, is disposed further upstream of the cleaning brush 54, which is disposed on the upstream side in the movement direction of the second transfer belt 26. The cleaning blade 64 is brought into contact with and separated from the surface of the second transfer belt 26 at a predetermined timing and removes residual substances that remain on the surface of the second transfer belt 26. The cleaning blade 64 is disposed so as to be brought into contact with a part of the surface of the second transfer belt 26 that is supported by the second support roller 45. The cleaning blade 64 is, for example, a flat plate made from aluminium or a stainless steel. Alternatively, the cleaning blade 64 may be a flat plate-shaped member made from a synthetic resin such as a polyurethane rubber. The cleaning blade 64 is disposed such that the proximal end thereof is located on the downstream side and the distal end thereof is located on the upstream side in the movement direction of the second transfer belt 26. The cleaning blade 64 is brought into contact with the second transfer belt 26 while the cleaning blade 64 is oriented in a direction extending from the downstream side toward the upstream side in the movement direction of the second transfer belt 26, which is opposite to the rotation direction of the second transfer belt 26. The cleaning blade 64 is a so-called doctor blade.

The cleaning blade 64 is disposed so that the cleaning blade 64 is brought into contact with the surface of the second transfer belt 26 at a predetermined scraping depth and separated from the surface by a contact/separation unit (not shown) at a predetermined timing. Examples of the predetermined timing at which the cleaning blade 64 is brought into contact with the surface of the second transfer belt 26 to clean the surface are as follows: when the image forming apparatus is switched on, when the cumulative number of the recording sheets 28 on which images have been formed reaches a predetermined value, when the cumulative number of revolutions of the photoconductor drum 14 reaches a predetermined value, and when the cumulative number of pixels of images formed on the photoconductor drum 14 reaches a predetermined value.

Figure 4:
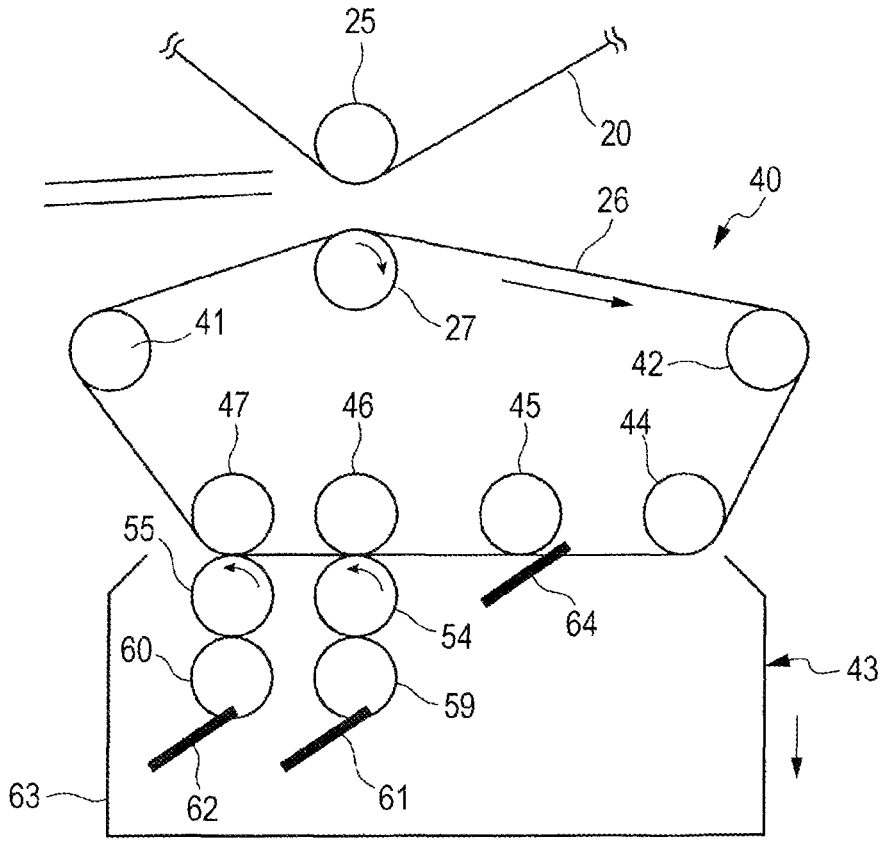
FIG. 4 illustrates an operation of the cleaning device.

The cleaning operation using the cleaning blade 64 is performed while, for example, the second transfer unit 40 is separated from the intermediate transfer belt 20 as illustrated in FIG. 4 by the contact/separation mechanism 401.

The cleaning blade 64 is brought into contact with and separated from the surface of the second transfer belt 26 at a predetermined timing in order to prevent the following failures that may occur if the cleaning blade 64 is always in pressed contact with the surface of the second transfer belt 26. If the cleaning blade 64 is made from a synthetic resin such as a polyurethane, friction between the cleaning blade 64 and the surface of the second transfer belt 26 is too high because friction-reducing effect due to toner is not expected because only a small amount of toner adheres to the second transfer belt 26, and thereby a failure such as abrasion of the cleaning blade 64 may occur. If the cleaning blade 64 is made from a metal, although abrasion does not occur, the surface of the second transfer belt 26 may be scratched by the cleaning blade 64, and thereby the life of the second transfer belt 26 may be shortened.

Moreover, when the cleaning blade 64 is configured to be pressed into contact with the surface of the second transfer belt 26 at a predetermined timing, a new technical problem arises in that the driving load of the second transfer belt 26 increases when the cleaning blade 64 is in pressed contact with the surface.

This technical problem, in that the driving load of the second transfer belt 26 increases, may be addressed by increasing an output torque of the driving motor 50 that drives the second transfer belt 26. However, an increase in the output torque of the driving motor 50 would cause a new technical problem in that the power consumption of the driving motor 50 increases, the size of the driving motor 50 and the space for installing the driving motor 50 increase, and the production cost increases. As illustrated in FIG. 3, in the image forming apparatus, the driving system for driving the second transfer belt 26 includes the torque limiter 52 that prevents the intermediate transfer belt 20 and the second transfer belt 26, each driven by a driving motor, from slipping over each other. It is difficult to set a set value (slipping torque) of the torque limiter 52 to be excessively high, because the set value directly influences the quality of an image that is second-transferred to the recording sheet 28. Thus, it may be difficult to make the drive toque be higher than a drive load.

For this reason, as illustrated in FIG. 1, the present exemplary embodiment includes a mechanism that assists driving of the second transfer belt 26 by switching the rotation direction of the two cleaning brushes 54 and 55 to a direction the same as that of the movement direction of the second transfer belt 26 when the cleaning blade 64 is brought into contact with the second transfer belt 26 to clean the surface of the second transfer belt 26.

As illustrated in FIG. 1, the two cleaning brushes 54 and 55 are rotated by the driving motor 56, which is rotated by driving pulses that are output from a drive circuit 65 that is controlled by control signals sent from a control circuit 66 that serves as a switching unit. When the cleaning blade 64 cleans the surface of the second transfer belt 26 at a predetermined timing, the control circuit 66 switches the rotation direction of the two cleaning brushes 54 and 55 to a direction the same as the movement direction of the second transfer belt 26.

With the structure described above, the image forming apparatus including the cleaning device according to the present exemplary embodiment is capable of preventing an increase in the driving load of the endless belt, which may occur when cleaning the endless belt, in the following manner.

That is, as illustrated in FIG. 2, in the image forming apparatus including the cleaning device 43 according to the present exemplary embodiment, the image forming units 13Y, 13M, 13C, and 13K respectively form toner images of yellow (Y), magenta (M), cyan (C), and black (K) on the photoconductor drums 14Y, 14M, 14C, and 14K. The toner images, which have been formed on the photoconductor drums 14Y, 14M, 14C, and 14K of the image forming units 13Y, 13M, 13C, and 13K are overlappingly first-transferred to the intermediate transfer belt 20. Then, the toner images are simultaneously second-transferred from the intermediate transfer belt 20 to the recording sheet 28 by the second transfer unit 40 at the second transfer position.

As illustrated in FIG. 2, the recording sheet 28, to which toner images of yellow (Y), magenta (M), cyan (C), and black (K) have been simultaneously second-transferred, is peeled off the second transfer belt 26 of the second transfer unit 40. Then, the recording sheet 28 is transported to the fixing device 30 by the transfer belt 29, is heated and pressed by the fixing device 30 so as to fix the toner images thereto, and is output to the output tray 31, which is disposed outside of the image forming apparatus body 1.

As illustrated in FIG. 2, in the image forming apparatus, the second transfer belt 26 of the second transfer unit 40 rotates while being in direct contact with the intermediate transfer belt 20. Therefore, residual substances, such as toner and toner additives adhering to or remaining on the surface of the intermediate transfer belt 20 and paper dust of the recording sheet 28, are likely to directly adhere to the surface of the second transfer belt 26. If toner adheres to the surface of the second transfer belt 26, the back side of the recording sheet 28 may become smudged. If toner additives, paper dust, and the like become deposited on the surface of the second transfer belt 26, second-transfer failure may occur.

To prevent this, as illustrated in FIGS. 1 and 2, the present exemplary embodiment includes the cleaning device 43 for cleaning the surface of the second transfer belt 26.

As illustrated in FIGS. 1 and 2, in the cleaning device 43 for cleaning the second transfer belt, when the image forming apparatus is performing a normal image forming operation, the two cleaning brushes 54 and 55 are constantly in contact with the surface of the second transfer belt 26 and are rotated in a direction (clockwise direction) that is opposite to the movement direction of the second transfer belt 26. A negative bias voltage is applied to the cleaning brush 54, which is disposed upstream of the cleaning brush 55 in the movement direction of the second transfer belt 26, so that the cleaning brush 54 removes toner that has been charged with a polarity opposite to the normal charge polarity (negative polarity). A positive bias voltage is applied the cleaning brush 55, which is disposed on the downstream of the cleaning brush 54 in the movement direction of the second transfer belt 26, so that the cleaning brush removes toner that has been charged with the normal charge polarity.

Therefore, toner charged with the polarity opposite to the normal charge polarity and toner charged with the normal charge polarity, which adhere to the surface of the second transfer belt 26, are removed from the surface of the second transfer belt 26 by a physical scraping effect due to the rotation of the two cleaning brushes 54 and 55 and the electrostatic attraction force. Then, the toner is recovered into the housing 63 of the cleaning device 43.

At this time, the cleaning blade 64 is located at a position at which the cleaning blade 64 is separated from the surface of the second transfer belt 26.

As described above, with the image forming apparatus, toner adhering to the surface of the second transfer belt 26 and charged with a polarity opposite to the normal charge polarity and toner adhering to the surface of the second transfer belt 26 and charged with the normal charge polarity are removed by the two cleaning brushes 54 and 55. However, residual substances such as toner additives and paper dust, whose particle diameter is smaller than that of the toner adhering to the surface of the second transfer belt 26, may not be sufficiently removed by the two cleaning brushes 54 and 55, and the residual substances may gradually become deposited on the surface of the second transfer belt 26 and adhere to the surface in a film-like shape.

To prevent this, as illustrated in FIG. 4, with the cleaning device 43 according to the present exemplary embodiment, the second transfer unit 40 is separated from the intermediate transfer belt 20 and the cleaning blade 64 is pressed into contact with the surface of the second transfer belt 26 at a predetermined timing, and thereby residual substances such as toner additives and paper dust adhering to the surface of the second transfer belt 26 in a film-like shape are scraped off by the cleaning blade 64. In FIG. 4, the cleaning blade 64 is disposed such that the cleaning blade 64 scrapes the surface of the second transfer belt 26 at a predetermined scraping depth. For convenience of drawing, in FIG. 4, the cleaning blade 64 is illustrated at a position at which the cleaning blade 64 would be located if the second transfer belt 26 was removed.

Residual substances, such as toner additives and paper dust, adhering to the surface of the second transfer belt 26 in a film-like shape are reliably removed by the cleaning blade 64, which is pressed into contact with the surface of the second transfer belt 26. However, when the cleaning blade 64 is pressed into contact with the surface of the second transfer belt 26, a load applied to the second transfer belt 26 is increased, and the driving load of the second transfer belt 26 increases.

If the cleaning blade 64 is pressed against the second transfer belt 26 too strongly, the driving load of the second transfer belt 26 may exceed the set value of the torque limiter 52. If this happens, the second transfer belt 26 may not be driven appropriately and the cleaning performance of the cleaning blade 64 may become impaired.

To prevent this, in the present exemplary embodiment, as illustrated in FIG. 4, when the cleaning blade 64 is pressed against the surface of the second transfer belt 26 to clean the surface, the control circuit 66 switches the rotation direction of the two cleaning brushes 54 and 55 to a direction the same as that of the rotation direction of the second transfer belt 26 so that the rotational driving forces of the two cleaning brushes 54 and 55 assist driving of the second transfer belt 26. As a result, even when the cleaning blade 64 is pressed against the surface of the second transfer belt 26, cleaning of the second transfer belt 26 is appropriately performed without increasing a driving current supplied to the driving motor 56 or without increasing the size of the driving motor 56. At this time, bias voltages are not applied to the two cleaning brushes 54 and 55.

With the present exemplary embodiment, by separating the second transfer belt 26 from the intermediate transfer belt 20 as illustrated in FIG. 4, it is not necessary to drive the intermediate transfer belt 20, and therefore toner and the like are prevented from being transferred from the intermediate transfer belt 20 to the second transfer belt 26 and adhering to the second transfer belt 26.

Second Embodiment

Figure 5:
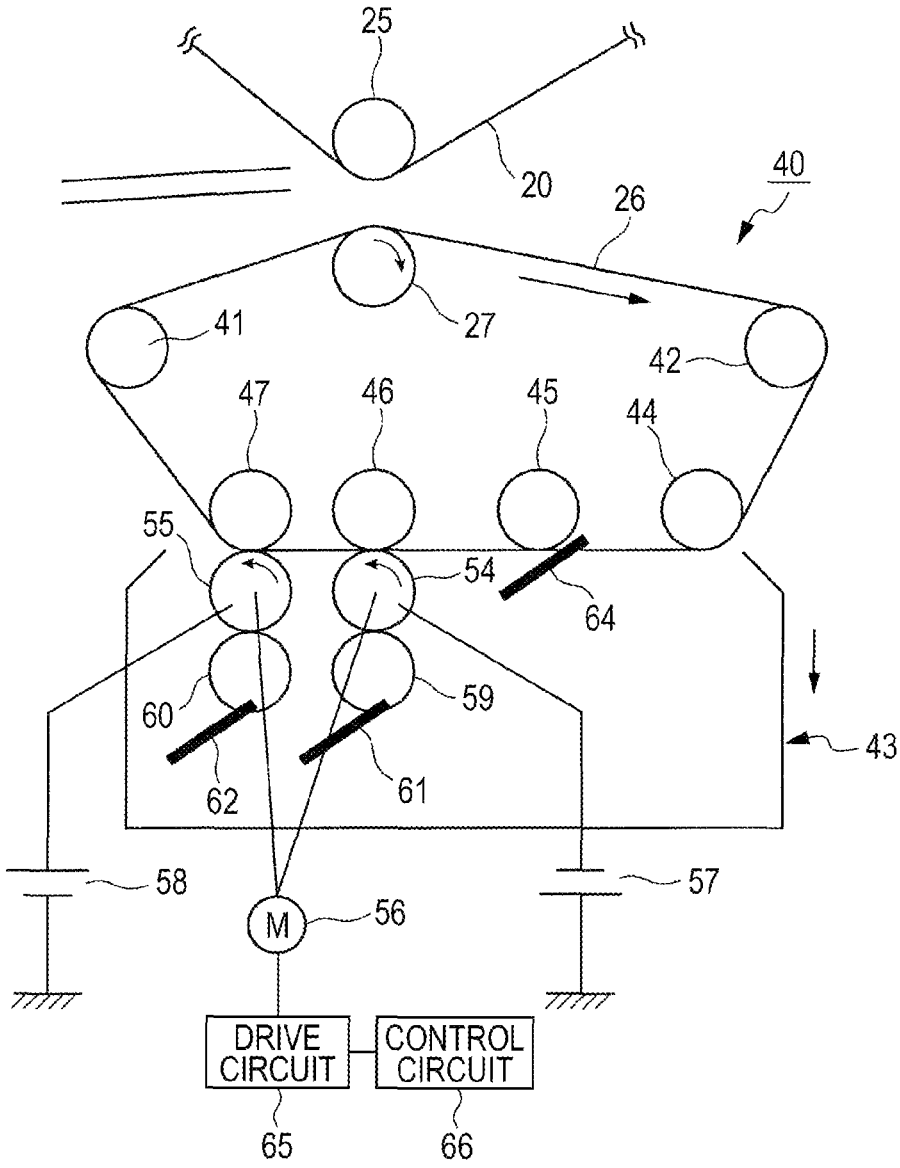
FIG. 5 is a partial schematic view of an image forming apparatus including a cleaning device according to a second exemplary embodiment of the present invention.

FIG. 5 illustrates a second exemplary embodiment of the present invention, in which the same components are denoted by the same numerals. In the second exemplary embodiment, the first cleaning member includes a rotatable cleaning brush, and a bias voltage is applied to the cleaning brush when the second cleaning member is brought into contact with the surface of the endless belt to clean the surface of the endless belt.

That is, in the second exemplary embodiment, the rotation direction of the two cleaning brushes 54 and 55 is switched to a direction the same as the movement direction of the second transfer belt 26 so that driving of the second transfer belt 26 is assisted by the rotational driving forces of the two cleaning brushes 54 and 55. However, the effect of assisting driving of the second transfer belt 26 may be small if the filaments of the two cleaning brushes 54 and 55 have worn out during use.

In the second exemplary embodiment, as illustrated in FIG. 5, the problem of decrease in the driving assist force of the two cleaning brushes 54 and 55, which may occur as the cumulative operating time of the image forming apparatus increases, is addressed as follows: when the cleaning blade 64 is pressed against the surface of the second transfer belt 26 to clean the surface, the control circuit 66 switches the rotation direction of the two cleaning brushes 54 and 55 to a direction the same as that of the rotation direction of the second transfer belt 26, and in addition, bias voltages are applied to the two cleaning brushes 54 and 55 by the bias power supplies 57 and 58. Thus, an electrostatic attraction force between each of the two cleaning brushes 54 and 55 and the second transfer belt 26 is increased, and thereby driving of the second transfer belt 26 is more effectively assisted by the driving forces of the two cleaning brushes 54 and 55. As a result, cleaning of the second transfer belt 26 is appropriately performed even when the cleaning blade 64 is pressed against the surface of the second transfer belt 26 without increasing a driving current supplied to the driving motor 56 or without increasing the size of the driving motor 56.

Other structures and functions, which are the same as those of the first exemplary embodiment, will be omitted.

EXAMPLE

Figure 6:
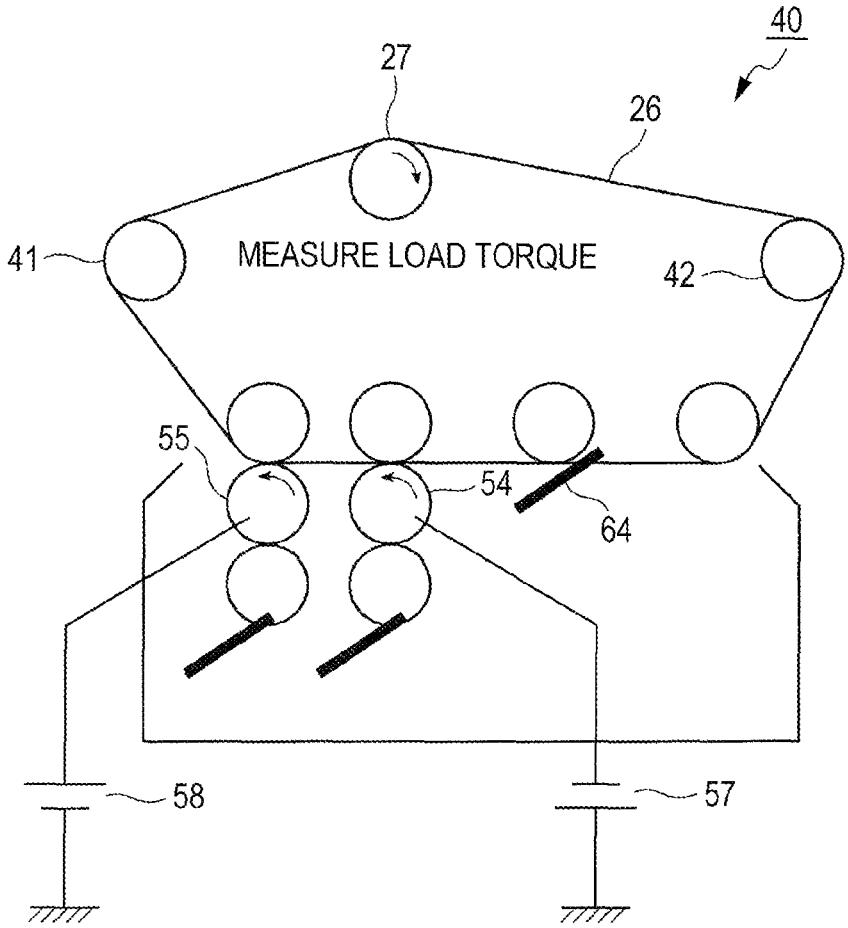
FIG. 6 illustrates an operation of a cleaning device that is used in an experiment.

The effects of the first and second exemplary embodiments are confirmed by an experiment using a benchmark model illustrated in FIG. 6, which includes only the second transfer unit 40. How the starting torque and the stable state torque of the second transfer roller 27 for driving the second transfer belt 26 change when the cleaning blade 64 is pressed against and separated from the surface of the second transfer belt 26 is measured while changing the scraping depth and the number of revolutions of the two cleaning brushes 54 and 55 and the presence/absence of bias voltages applied to the two cleaning brushes 54 and 55. In addition, the assist forces generated by the two cleaning brushes 54 and 55 are evaluated.

FIG. 7 is a table illustrating the result of the experiment.

As is clear from FIG. 7, when the cleaning blade 64 is separated from the surface of the second transfer belt 26, the starting torque is 4.5 N·cm and the steady state torque is 4.1 N·cm, which are low. In contrast, when the cleaning blade 64 is in pressed contact with the second transfer belt 26, the starting torque is 10.4 N·cm and the steady state torque is 9.7 N·cm, which are larger than double the values of the above case, indicating an increase in the load of the driving system for driving the second transfer belt 26. At this time, the two cleaning brushes 54 and 55 are not rotating and serving as a driving load.

When the two cleaning brushes 54 and 55 are rotated with the number of revolutions of 87.24 rpm in a direction the same as the movement direction of the second transfer belt 26, the starting torque is reduced to 5.5 N·cm and the steady state torque is reduced to 4.8 N·cm, which are respectively low and approximately equal to the starting torque of 4.5 N·cm and the steady state torque of 4.1 N·cm when the cleaning blade 64 is separated from the surface of the second transfer belt 26. This shows that the effect of assisting driving of the two cleaning brushes 54 and 55 is obtained. The assisting force at this time is evaluated at 1.8 N·cm.

When a bias voltage of 200 V is applied to each of the two cleaning brushes 54 and 55, although the starting torque slightly increases to 5.7 N·cm from the case where a bias voltage is not applied, the steady state torque decreases to 4.7 N·cm and the assist force is evaluated at 1.9 N·cm.

As is clear from FIG. 7, the result of a similar experiment, in which the scraping depth of the two cleaning brushes 54 and 55 are nearly halved from 1.4 mm to 0.75 mm, is similar to that of the case where the scraping depth is

Third Embodiment

Figure 8:
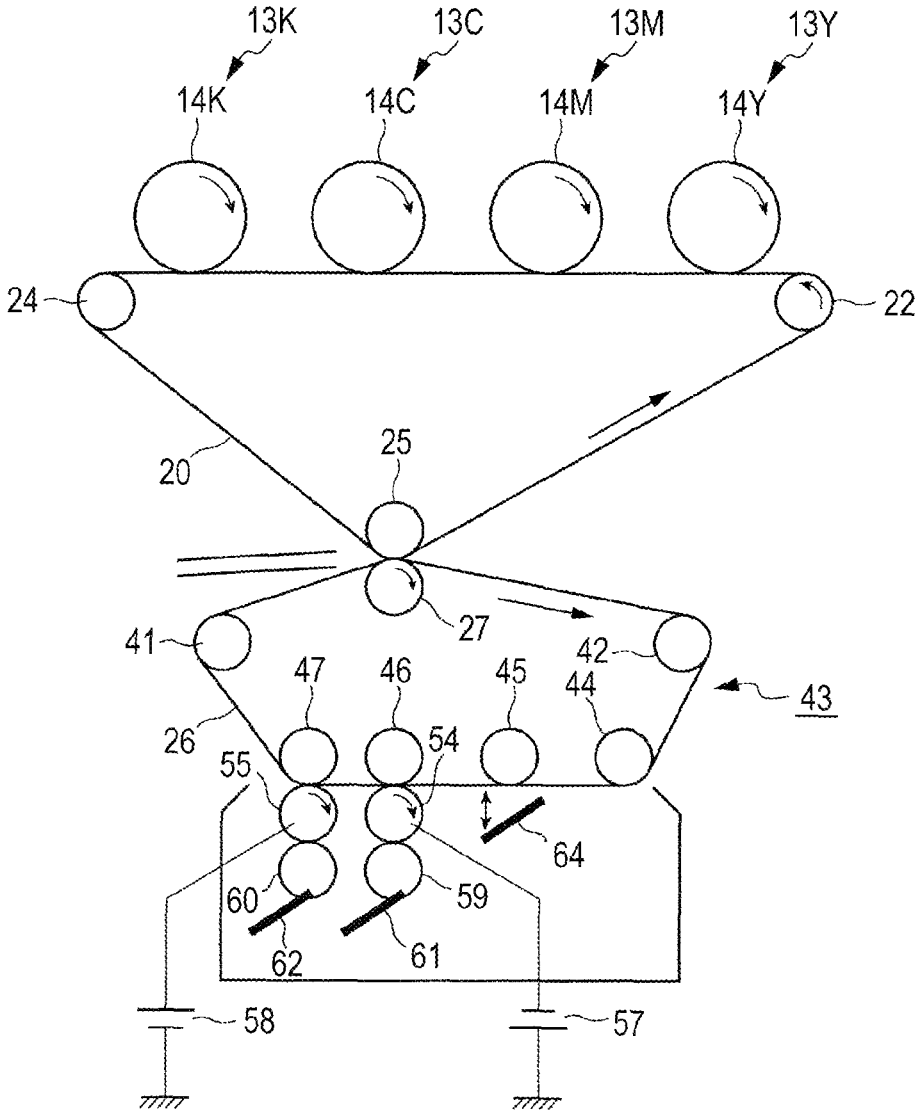
FIG. 8 is a partial schematic view of an image forming apparatus including a cleaning device according to a third exemplary embodiment of the present invention.

FIG. 8 illustrates a third exemplary embodiment of the present invention. Components that are the same as those of the first and second exemplary embodiments will be denoted by the same numerals. In the third exemplary embodiment, the second transfer belt is always in contact with the intermediate transfer member.

That is, in the third exemplary embodiment, as illustrated in FIG. 8, the second transfer belt 26 is not separable from the intermediate transfer belt 20, and the second transfer belt 26 is always in contact with the intermediate transfer belt 20.

In this case, the contact/separation mechanism 401 is not necessary, so that the structure of the image forming apparatus is simplified. Moreover, it is not necessary to make the second transfer belt 26 be separable from the intermediate transfer belt 20, and thereby the productivity of the image forming apparatus is increased.

Description of other structures and functions, which are the same as those of the first exemplary embodiment, will be omitted.

In the exemplary embodiments, as illustrated in FIG. 1, the cleaning blade 64 is disposed upstream of the two cleaning brushes 54 and 55 in the movement direction of the second transfer belt 26. However, the cleaning blade 64 may be disposed between the two cleaning brushes 54 and 55 or downstream of the two cleaning brushes 54 and 55 in the movement direction of the second transfer belt 26.

However, for the purpose of preventing variation in the driving torque of the second transfer belt 26, which occurs when the cleaning blade 64 is brought into contact with and separated from the second transfer belt 26, from affecting the meandering control roller 41, the cleaning blade 64 may be disposed upstream of the two cleaning brushes 54 and 55 in the movement direction of the second transfer belt 26.

In the exemplary embodiments described above, as illustrated in FIG. 1, a cleaning blade is used as a second cleaning member. However, instead of the cleaning blade, a cleaning roller may be used as the second cleaning member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

at least one first cleaning member configured to remove residual substances that remain on a surface of an endless belt by being in contact with the surface of the endless belt while rotating in a direction that is opposite to a movement direction in which the endless belt moves;

a second cleaning member that is brought into contact with and separated from the surface of the endless belt at a predetermined timing and that is configured to remove the residual substances that remain on the surface of the endless belt; and a switching unit configured to switch a rotation direction of the first cleaning member to a direction the same as the movement direction of the endless belt when the second cleaning member is brought into contact with the surface of the endless belt and cleans the surface.

2. The cleaning device according to claim 1, wherein the first cleaning member includes a rotatable cleaning brush, and a bias voltage is applied to the cleaning brush in response to the second cleaning member being in contact with the surface of the endless belt and configured to clean the surface of the endless belt.

3. The cleaning device according to claim 1, wherein the first cleaning member includes two rotatable cleaning brushes, and wherein a bias voltage having an opposite polarity is applied to one of the two cleaning brushes, the opposite polarity being opposite to a normal charge polarity with which the residual substances are charged, and a bias voltage having a polarity the same as the normal charge polarity is applied to the other of the two cleaning brushes.

4. An image forming apparatus comprising:

at least one image carrier configured to carry a toner image;

an intermediate transfer member to which the toner image is transferred from the image carrier;

the cleaning device according to claim 1; and the endless belt configured to transfer the toner image from the intermediate transfer member to a recording medium.

5. The image forming apparatus according to claim 4, wherein the endless belt is looped over a plurality of rollers including a second transfer roller, a meandering control roller, and a peel-off roller; the second transfer roller is disposed at a second transfer position at which the endless belt is in contact with the intermediate transfer member, the second transfer roller driving the endless belt; the meandering control roller is disposed upstream of the second transfer roller in a movement direction in which the endless belt moves, the meandering control roller controlling meandering of the endless belt; and the peel-off roller is disposed downstream of the second transfer roller in the movement direction of the endless belt, the peel-off roller peeling the recording medium off the endless belt.

6. The image forming apparatus according to claim 4, wherein the endless belt is disposed so as to be brought into contact with and separated from the intermediate transfer member, and the second transfer roller is rotated by a driving unit at a circumferential speed that is larger than a movement speed of the intermediate transfer member through a torque limiter that transmits only a torque that is equal to or smaller than a set value.

7. The image forming apparatus according to claim 4, wherein the endless belt is disposed so as to be always in contact with the intermediate transfer member.

* * * * *